US007459257B2

(12) United States Patent
Shirodai et al.

(10) Patent No.: US 7,459,257 B2
(45) Date of Patent: Dec. 2, 2008

(54) IMAGE FORMING APPARATUS AND IMAGE FORMING METHOD

(75) Inventors: Yasuo Shirodai, Itami (JP); Kuniaki Kashiwakura, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 294 days.

(21) Appl. No.: 11/007,198

(22) Filed: Dec. 9, 2004

(65) Prior Publication Data

US 2006/0045592 A1 Mar. 2, 2006

(30) Foreign Application Priority Data

Aug. 27, 2004 (JP) ..... 2004-247695

(51) Int. Cl.
*G03G 13/16* (2006.01)
*G03G 21/00* (2006.01)

(52) U.S. Cl. ..... 430/126.2; 430/120.1; 430/119.7; 430/119.8; 399/346

(58) Field of Classification Search ..... 430/120, 430/125, 120.1, 126.2, 119.7, 119.8; 399/346
See application file for complete search history.

(56) References Cited

U.S. PATENT DOCUMENTS 3,635,704 A * 1/1972 Palermiti et al. ..... 430/125
2003/0044201 A1* 3/2003 Kosuge ..... 399/223
2003/0049555 A1* 3/2003 Sakon et al. ..... 430/124

FOREIGN PATENT DOCUMENTS

| | | |
|---|---|---|
| JP | 63-096663 | 4/1988 |
| JP | 07-311531 | 11/1995 |
| JP | 2001-318475 | 11/2001 |
| JP | 2002-244486 | 8/2002 |
| JP | 2003-149995 | 5/2003 |
| JP | 2003-263069 | 9/2003 |
| JP | 2003-316201 | 11/2003 |

* cited by examiner

*Primary Examiner*—Mark A Chapman
(74) *Attorney, Agent, or Firm*—Buchanan Ingersoll & Rooney PC

(57) ABSTRACT

An image forming apparatus of the present invention comprises an image carrier, a lubricant application device that applies a first lubricant to the image carrier surface, and a developing device that houses a developer to which a second lubricant is added and develops the electrostatic latent image formed on the image carrier. Here, the pure water contact angle θ1 of the first lubricant and the pure water contact angle θ2 of the second lubricant have the following relationship, θ1≦θ2. Furthermore, a frictional coefficient of the second lubricant may be larger than a frictional coefficient of the first lubricant.

26 Claims, 9 Drawing Sheets

M1: ST-Al
M2: ○:ST-Al
△:ST-Mg
●: No solid lubricant was added

FIG.8

| Solid lubricant M1 | | Solid lubricant M2 | | Rate of contact angle reduction |
|---|---|---|---|---|
| Kind | Contact angle $\theta 1$(° ) | Kind | Contact angle $\theta 2$(° ) | |
| ST-Zn | 105 | ST-Na | 55 | -7.1 |
| ST-Zn | 105 | ST-H | 81 | -4.8 |
| ST-Zn | 105 | ST-Li | 92 | -4.2 |
| ST-Zn | 105 | ST-Ca | 103 | -3.8 |
| ST-Zn | 105 | ST-Ba | 103 | -3.8 |
| ST-Zn | 105 | ST-Zn | 105 | 0 |
| ST-Zn | 105 | St-Mg | 110 | 0 |
| ST-Zn | 105 | ST-Al | 110 | 0 |
| ST-Zn | 105 | No addition | - | -5.0 |
| ST-Ca | 103 | ST-Na | 55 | -6.9 |
| ST-Ca | 103 | ST-H | 81 | -4.6 |
| ST-Ca | 103 | ST-Li | 92 | -4.0 |
| ST-Ca | 103 | ST-Ca | 103 | 0 |
| ST-Ca | 103 | ST-Ba | 103 | 0 |
| ST-Ca | 103 | ST-Zn | 105 | 0 |
| ST-Ca | 103 | St-Mg | 110 | 0 |
| ST-Ca | 103 | ST-Al | 110 | 0 |
| ST-Ca | 103 | No addition | - | -5.0 |

FIG.9

| Solid lubricant M1 | | Solid lubricant M2 | | Minimum contact pressure (N/m) |
|---|---|---|---|---|
| Kind | Frictional coefficient $\mu 1$(° ) | Kind | Frictional coefficient $\mu 2$(° ) | |
| ST-Zn | 0.14 | ST-Ca | 0.1 | 18 |
| ST-Zn | 0.14 | ST-Li | 0.12 | 16 |
| ST-Zn | 0.14 | ST-Ba | 0.12 | 16 |
| ST-Zn | 0.14 | ST-Zn | 0.14 | 15 |
| ST-Zn | 0.14 | St-Mg | 0.17 | 14 |
| ST-Zn | 0.14 | ST-Na | 0.18 | 14 |
| ST-Zn | 0.14 | ST-H | 0.23 | 12 |
| ST-Zn | 0.14 | ST-Al | 0.34 | 10 |
| ST-Zn | 0.14 | No addition | — | 15 |

IMAGE FORMING APPARATUS AND IMAGE FORMING METHOD

RELATED APPLICATIONS

This disclosure is based upon Japanese Patent Application No. 2004-247695, filed Aug. 27, 2004, the contents of which are incorporated herein by reference.

BACKGROUND OF THE INVENTION

1. Field of the Invention

The present invention relates to an image forming apparatus and image forming method, and more particularly, to an image forming apparatus and image forming method that increase the useful life of the image carrier and improve the image quality by supplying a lubricant to the image carrier.

2. Description of the Related Art

An image forming apparatus of the conventional art using the electrophotographic method, such as a copier or printer, uniformly charges the surface of an image carrier (e.g., a photoreceptor drum) using a charger and forms an electrostatic latent image thereon by exposing the image carrier with light modulated based on the image. The formed electrostatic latent image is developed using toner into a toner image, which is then transferred to a recording medium or to an intermediate transfer unit and then to a recording medium, and the transferred toner image is heated by a fusing device such that it fuses to the recording medium, thereby forming a final image.

Image forming apparatuses of this type include a cleaning device that removes and cleans off the residual toner from the photoreceptor after the toner image formed on the image carrier (e.g., a photoreceptor drum) or the intermediate transfer unit (hereinafter referred to as an 'image carrier') is transferred to the recording medium.

The cleaning device is often of the type in which a cleaning blade is brought into contact with the image carrier surface to scrape off the residual toner. However, using this construction, substantial friction between the cleaning blade and the image carrier shaves away the photosensitive film on the image carrier surface and/or wears down the cleaning blade, causing a reduction in the useful lives of both component members.

As a countermeasure against this problem, a technology is known whereby a lubricant is applied to the image carrier surface to reduce the frictional coefficient thereof, thereby preventing wear on the cleaning blade and damage to the photosensitive film on the image carrier surface and extending the useful lives of the component members. However, this technology entails the problem that when the residual toner is removed using a cleaning blade, the toner that has been scraped off adheres to and remains on the blade edge, and the lubricant applied to the image carrier surface is scraped off by the residual toner.

Accordingly, a method has been proposed in which an application brush is used to carry solid lubricant, which is then applied to the image carrier surface by bringing the application brush into contact therewith. For example, according to Japanese Patent Application Laid-Open No. 2002-244486, the degree by which the application brush is pushed into a solid lubricant and the rotation rate of the application brush are controlled based on information regarding the cumulative drive time of the image carrier sought from the cumulative number of prints as well as on the counter value for the number of dots in the image, which indicates the black/white ratio.

Japanese Patent Application Laid-Open No. 7-311531 proposes a technology in which the amount of lubricant applied to the surface of the image carrier is detected, and based on the detection result, the rotation of the application brush is controlled to be ON or OFF, or the rotation rate of the application brush is controlled.

However, using an image forming apparatus of the conventional art described above, such information as the image carrier cumulative drive time and the counter value for the number of effective dots in the image (which indicates the black/white ratio) must be collected and processed, or means to detect the amount of lubricant applied to the image carrier surface and control the rotation of the application brush are needed, which makes the construction of the apparatus complex and increases the manufacturing cost.

SUMMARY OF THE INVENTION

An object of the present invention is to provide an image forming apparatus and image forming method that do not require special means such as the lubricant application control means that is required by the image forming apparatus of the conventional art and that can maintain the amount of lubricant on the image carrier surface at an appropriate level.

The image forming apparatus of the present invention comprises an image carrier, a lubricant application device that applies a first lubricant to the image carrier surface, and a developing device that houses a developer to which a second lubricant is added and develops the electrostatic latent image formed on the image carrier. Here, the pure water contact angle $\theta 1$ of the first lubricant and the pure water contact angle $\theta 2$ of the second lubricant have the relationship expressed by the formula (1):

$$\theta 1 \leqq \theta 2 \quad (1)$$

In other words, according to the present invention, the surface energy of the developer is reduced by coating the toner particle surfaces with the second lubricant having a smaller surface energy than the first lubricant applied to the image carrier surface.

As a result, the peeling off of the first lubricant applied to the image carrier surface by the toner adhering to the cleaning blade edge can be reduced.

The image forming apparatus of the present invention comprises an image carrier, a lubricant application device that applies a first lubricant to the image carrier surface and a developing device that houses a developer to which a second lubricant is added and that develops the electrostatic latent image formed on the image carrier. Here, the frictional coefficient $\mu 1$ of the first lubricant and the frictional coefficient $\mu 2$ of the second lubricant have the relationship expressed by the formula (2):

$$\mu 1 < \mu 2 \quad (2)$$

In other words, according to the present invention, by coating the toner particle surfaces with a second lubricant having a frictional coefficient $\mu 2$ that is larger than the frictional coefficient $\mu 1$ of the first lubricant applied to the image carrier surface, the friction among toner particles in the toner pool formed by removed toner that adheres to and remains on the blade edge is increased, such that it is more difficult for the toner particles to slip through the blade edge, thereby reducing the incidence of cleaning failure.

BRIEF DESCRIPTION OF THE DRAWINGS

These and other objects and features of the present invention will become clear from the following description taken in conjunction with the preferred embodiments thereof with reference to the accompanying drawings, in which:

FIG. 8 is a drawing showing measurement results regarding the rate of reduction of the pure water contact angle of the photoreceptor surface when zinc stearate (ST-Zn) and calcium stearate (ST-Ca) were respectively applied to the photoreceptor surface as the solid lubricant M1 and various stearates or stearic acid were respectively used as the solid lubricant M2 added to the toner; and FIG. 9 is a drawing showing measurement results regarding the minimum contact pressure when zinc stearate (ST-Zn) was applied to the photoreceptor surface as the solid lubricant M1 and various stearates or stearic acid were respectively used as the solid lubricant M2 added to the toner.

DESCRIPTION OF THE PREFERRED EMBODIMENTS

Figure 1:
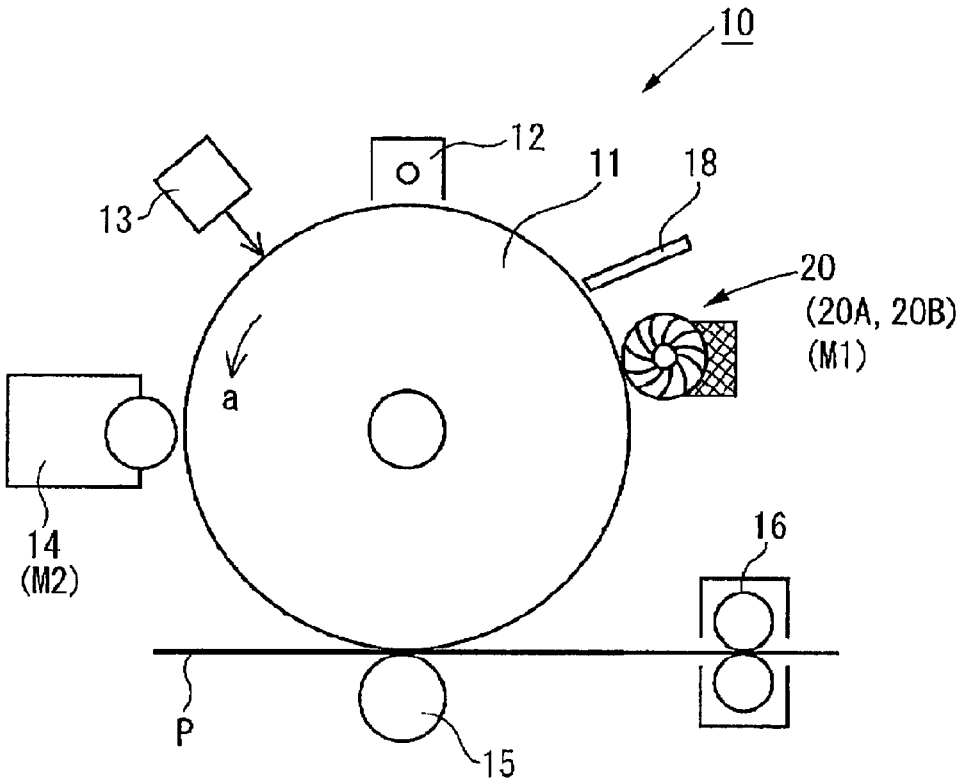
FIG. 1 is an explanatory drawing showing in a schematic fashion an example of the basic construction of the image forming apparatus of the present invention.

FIG. 1 is an explanatory drawing showing in a schematic fashion an example of the construction of the image forming apparatus of the present invention. Because the image forming apparatus itself is a public-domain electrophotographic image forming apparatus, it will not be described in detail herein.

With reference to FIG. 1, the image forming apparatus 10 includes a photoreceptor drum 11 comprising an image carrier that rotates at a fixed speed in the direction of the arrow (a) based on a driving device not shown, a main charger 12 disposed near the photoreceptor drum 11, an exposure device 13, a developing device 14 that houses a developer that includes a solid lubricant M2 comprising the second lubricant, a transfer device 15, a fusing device 16, and a cleaning device 18 that includes a cleaning blade that is disposed in contact with the photoreceptor drum 11. Disposed downstream from the transfer device 15 and upstream from the cleaning device 18 is a lubricant application device 20 that includes an application brush that is in contact with the photoreceptor drum 11 and applies thereon a solid lubricant M1, which comprises the first lubricant.

The properties of the solid lubricant M1, i.e., the first lubricant, and the solid lubricant M2, i.e., the second lubricant, as well as the lubricant application device 20 that includes an application brush that applies the solid lubricant M1, are described in detail below.

The image formation operation carried out by the image forming apparatus will be described briefly. The surface of the photoreceptor drum 11 is first charged uniformly by the main charger 12. Laser light emitted from the laser device of the exposure device 13 is modulated based on the image signals output from the scanning optical system based on the reading of an original document image placed on a platen not shown or on image signals output from a personal computer or the like not shown, and the modulated light is projected onto the surface of the photoreceptor drum 11, whereby an electrostatic latent image is formed.

The electrostatic latent image formed on the surface of the photoreceptor drum 11 is developed using the developer housed in the developing device 14, whereby a toner image is formed. A recording medium P is conveyed from a paper supply device not shown synchronously with the arrival of the toner image formed on the surface of the photoreceptor drum 11 at the transfer device 15, i.e., the transfer position, based on the rotation of the photoreceptor drum 11 in the direction of the arrow (a). At the transfer position, the toner image formed on the surface of the photoreceptor drum 11 is transferred to the recording medium P based on the operation of the transfer device 15. The recording medium P is then conveyed to the fusing device 16, whereby the toner image on the recording medium P is fused thereto, and the recording medium P is ejected onto an eject tray not shown.

The waste toner remaining on the surface of the photoreceptor drum 11 that was not used for image transfer is cleaned off and removed by the cleaning device 18, and the apparatus moves onto the next image forming operation.

The lubricant application device 20 will now be described. The lubricant application device 20 may comprise one of the two embodiments described below, i.e., a lubricant application device 20A or a lubricant application device 20B. While each of them applies solid lubricant by bringing an application brush into contact with the photoreceptor drum 11, they differ in terms of the construction used to load solid lubricant onto the application brush.

Figure 2A:
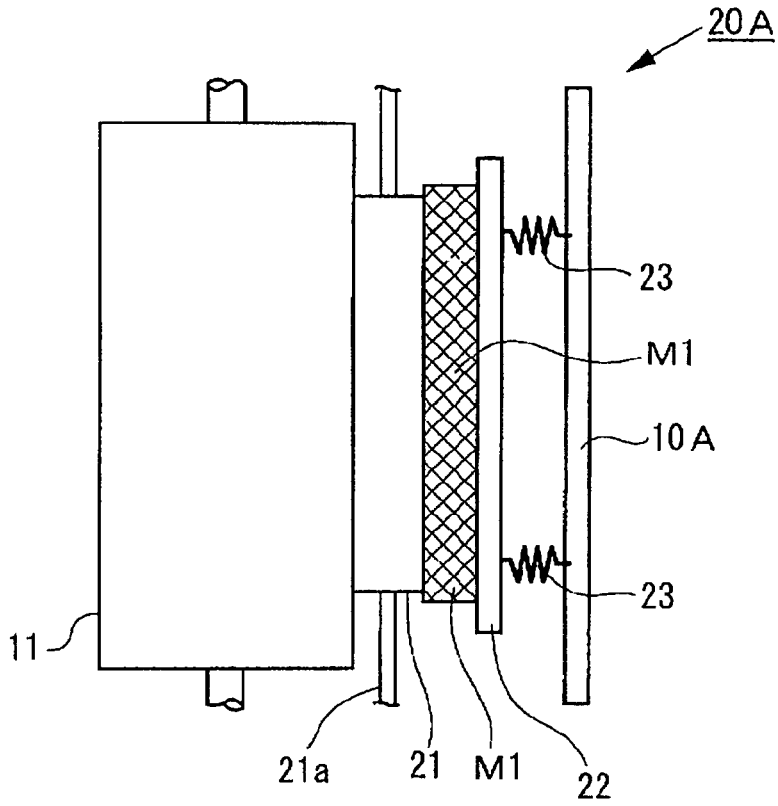
FIG. 2 is an explanatory drawing showing the construction of a first embodiment of the lubricant application device.
Figure 2B:
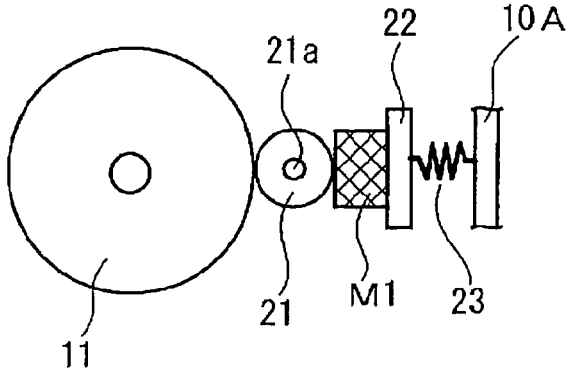

FIG. 2 is an explanatory drawing showing the construction of the lubricant application device 20A comprising a first embodiment of the lubricant application device 20. FIG. 2(*a*) is a front elevation of the lubricant application device 20A and FIG. 2(*b*) is a side elevation thereof. The application brush 21 includes a rotating shaft 21*a*, and is disposed such that the application brush 21 is aligned parallel to the surface of the photoreceptor drum 11 with a certain degree of contact therewith in order for the application brush 21 to rotate in tandem with the rotation of the photoreceptor drum 11.

The solid lubricant M1 is held by a holding plate 22, and a compressed spring 23 is disposed between the holding plate 22 and the housing 10A of the image forming apparatus. The solid lubricant M1 held by the holding plate 22 is pressed toward the application brush 21 by the force of the compressed spring 23.

Based on this construction, when the application brush 21 rotates in tandem with the rotation of the photoreceptor drum 11, the bristles of the application brush 21 take up small amounts of the solid lubricant M1, and the solid lubricant M1 adhering to the bristles is applied to the surface of the photoreceptor drum 11.

Figure 3A:
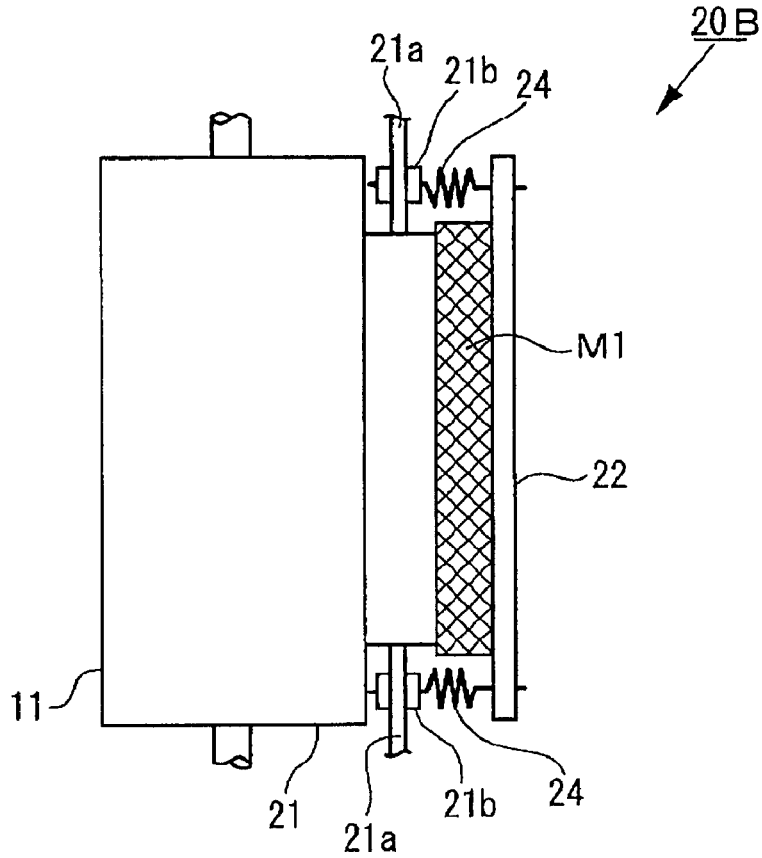
FIG. 3 is an explanatory drawing showing the construction of a second embodiment of the lubricant application device.
Figure 3B:
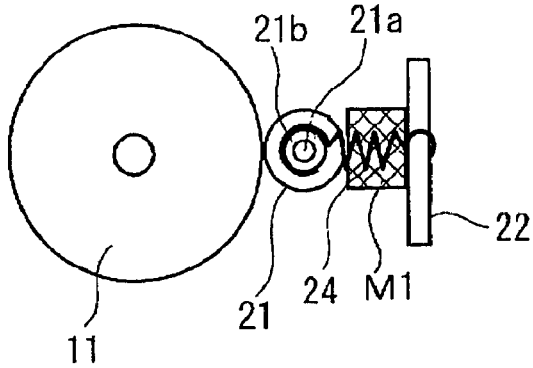

FIG. 3 is an explanatory drawing showing the construction of the lubricant application device 20B comprising a second embodiment of the lubricant application device 20. FIG. 3(*a*) is a front elevation of the lubricant application device 20B and FIG. 3(*b*) is a side elevation thereof. This second embodiment is the same as the first embodiment in that the application brush 21 includes a rotating shaft 21*a* and is disposed such that the application brush 21 is aligned parallel to the surface of the photoreceptor drum 11 with a certain degree of contact therewith in order for the application brush 21 to rotate in tandem with the rotation of the photoreceptor drum 11.

The solid lubricant M1 is held by a holding plate 22, and a pulled spring 24 is disposed between the holding plate 22 and the bearing 21*b* of the rotating shaft 21*a* of the application brush 21. The solid lubricant M1 held by the holding plate 22 is pulled toward the application brush 21.

Based on this construction, when the application brush 21 rotates in tandem with the rotation of the photoreceptor drum 11, the bristles of the application brush 21 take up small amounts of the solid lubricant M1, and the solid lubricant M1 adhering to the bristles is applied to the surface of the photoreceptor drum 11.

In addition, in the second embodiment 20B of the lubricant application device, because, unlike in the first embodiment 20A described above, the housing 10A is not used as a support member for the compressed spring 23, such variables as the variations in the gap between the housing 10A and the holding plate 22 (i.e., the solid lubricant M1) and the slanting of the rotating shaft of the application brush 21 have no bearing on the location of the application 21, and the solid lubricant M and the application brush 21 are maintained parallel to each other at all times. Accordingly, the solid lubricant M1 can be taken up uniformly at either end of the application brush 21, ensuring stable take-up.

Figure 4:
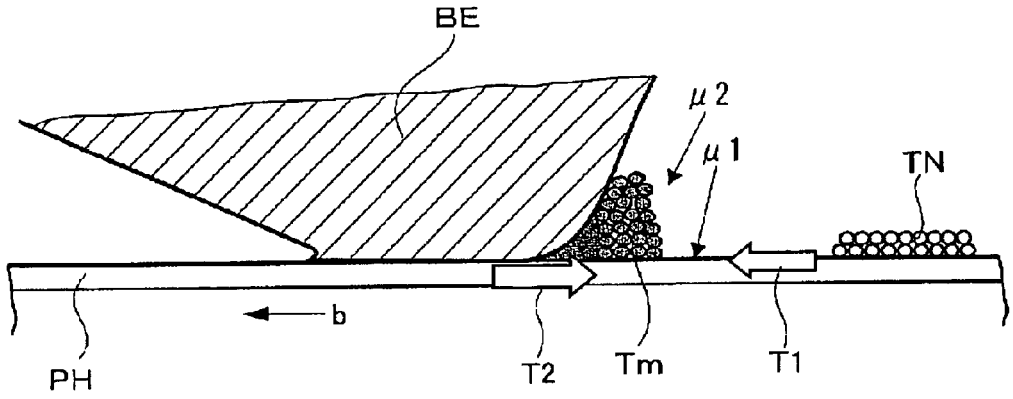
FIG. 4 is an explanatory drawing showing the mechanism by which toner scrapes off the solid lubricant.

The peeling off of the solid lubricant on the photoreceptor surface by toner will now be explained. FIG. 4 is an explanatory drawing showing the peeling mechanism. The situation in which the blade edge BE of the cleaning blade is in contact with the photoreceptor PH is shown in enlargement.

When the photoreceptor PH moves in the direction of the arrow (b), the residual toner TN on the photoreceptor PH is stopped and scraped off by the blade edge BE. When this occurs, the toner TN on the photoreceptor PH collides with the edge BE of the cleaning blade with an impact force T1, and force T2 to repel the toner TN is generated on the edge BE. The smaller the frictional coefficient μ1 between the photoreceptor PH and the toner TN, the smaller the impact force T1 of the toner TN becomes, enabling cleaning to be achieved easily.

Scraped off toner TN remains along the very edge of the blade edge BE, creating a toner pool Tm. The toner pool Tm on the blade edge BE tends to become denser and more marked as the toner particle diameter decreases. Previously pooled toner particles and toner particles that currently enter the pool collide in the toner pool Tm, which peels off the solid lubricant on the photoreceptor PH.

Formation of a toner pool Tm is important for cleaning, but where the toner is highly fluid, or when the toner particle diameter decreases, the pool density increases and the amount of toner that escapes through the blade increases, resulting in cleaning failure. In order to effectively scrape off the residual toner via the blade edge BE, it is preferred that the residual toner separate from the photoreceptor easily and that there be little frictional resistance between the toner particles already in the toner pool Tm and the toner particles entering the toner pool Tm.

The frictional coefficient μ1 between the photoreceptor PH and the toner TN should be reduced in order to reduce the toner's impact force T1. In order to form a toner pool Tm by increasing the toner's repulsion force T2, the frictional coefficient μ2 between the toner TN particles already in the toner pool Tm and the toner particles entering the toner pool Tm should be increased.

Accordingly, in the present invention, two types of solid lubricants, the relationship of whose pure water contact angles can be expressed by the following formula (1), are selected. A solid lubricant M1 having a pure water contact angle θ1 is used as the solid lubricant applied to the photoreceptor, and a solid lubricant M2 having a pure water contact angle θ2 is used as the solid lubricant added to the developer.

$$\theta 1 \leqq \theta 2 \quad (1)$$

where, θ1: the pure water contact angle of the solid lubricant M1

θ2: the pure water contact angle of the solid lubricant M2

The frictional coefficient of the solid lubricant M1 and the frictional coefficient of the solid lubricant M2 may also have the relationship expressed by the following formula (2):

$$\theta 1 < \theta 2 \quad (2)$$

where, μ1: the frictional coefficient of the solid lubricant M1

μ2: the frictional coefficient of the solid lubricant M2

As a result, because the photoreceptor surface comes to be coated with the solid lubricant M1 having the frictional coefficient μ1 (or the pure water contact angle θ1) and the friction between the photoreceptor and the toner becomes reduced, the residual toner is easily separated from the photoreceptor. In addition, because the surfaces of the toner particles in the developer come to be coated with the solid lubricant M2 having a frictional coefficient μ2 (or a pure water contact angle θ2), the frictional resistance between the toner particles already in the toner pool and the toner particles entering the toner pool increases. Consequently, a toner pool Tm is appropriately formed and the peeling off of the solid lubricant M1 by the toner on the blade edge BE is reduced.

[Pure Water Contact Angle and Frictional Coefficient]

The relationship between the pure water contact angle and the frictional coefficient of a solid lubricant will be explained. The significance of the contact angle will first be explained. A contact angle is the angle of contact between a liquid surface and a solid surface at the point of contact therebetween when the free surface of the liquid is in equilibrium contact with the solid surface, which could be a solid wall surface or horizontal surface. The angle is taken as the angle between the solid surface and the surface of the liquid that is not in contact with the solid surface. When the contact angle is acute, such state is expressed as 'wet', indicating the solid surface to be an easily wetted surface. When the contact angle is obtuse, such state is expressed as 'not wet', indicating a solid surface that does not easily become wet.

Therefore, the pure water contact angle of a solid lubricant is a value that indicates the ease with which the photoreceptor surface coated with the solid lubricant becomes wet with pure water. In other words, it can be used as an indicator of the surface state coated with various lubricants.

The method by which to measure the pure water contact angle of a solid lubricant will now be explained. Polycarbonate resin, which is the raw material of the image carrier, and the styrene-acrylic resin mixture, which is the raw material of the toner, were formed into sheets, and measurement samples were created by uniformly coating such sheets with various solid lubricants. The pure water contact angle of these measurement samples was measured using a contact angle measurement device manufactured by Kyowa Kaimen Kagaku Co., Ltd. In this measurement, the raw material resin sheets did not have any effect on the measured contact angle result. Namely, so long as the same solid lubricant was used, the measured contact angle was identical regardless of the type of the raw material resin. In addition, where necessary, the photoreceptor surface coated with a solid lubricant was directly measured, instead of using measurement samples as described above.

Figure 5:
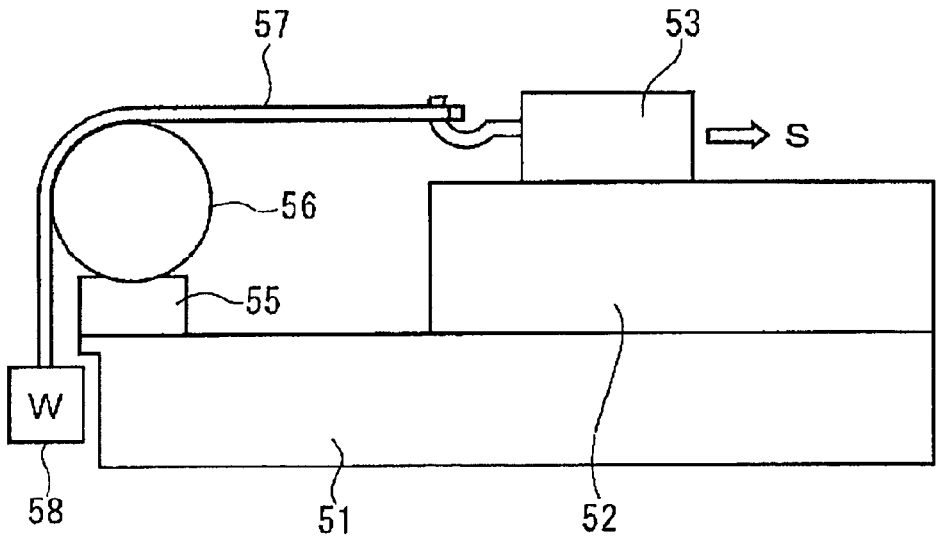
FIG. 5 is an explanatory drawing showing a frictional coefficient measurement device using the Euler belt method.

The method by which to measure the frictional coefficient of a solid lubricant will now be explained. The frictional coefficient was measured using the Euler belt method. FIG. 5 is an explanatory drawing showing the construction of the frictional coefficient measurement device using the Euler belt approach. A digital force gauge 53 was placed on a measurement platform 52 horizontally fixed at one end of a table 51, and a cylindrical unit 56 deemed a photoreceptor and comprising the object of measurement was placed on a photoreceptor table 55 disposed at the other end of the table 51. A belt 57 was placed such that it was in contact with the cylindrical surface of the cylindrical unit 56, and one end of the belt 57 was linked to the digital force gauge 53 via a hook. A plumb bob 58 was linked to the other end of the belt 57 such that a prescribed weight W would be added to the belt 58 via a hook.

The digital force gauge was then pulled to the right in FIG. 5 (the direction indicated by the arrow S) in this state. The digital force gauge was read (i.e., the reading F) at the time that the belt 57 began moving, and the frictional coefficient μ of the cylindrical surface of the cylindrical unit 56, which was deemed the photoreceptor, was calculated using the following mathematical formula (3):

$$\mu = 1n(F/W)/(\pi/2) \quad (3)$$

where, 1n: a natural logarithm symbol

F: the digital force gauge reading

W: the weight of the plumb bob

When measuring the frictional coefficient μ1 between the photoreceptor PH and the toner TN, a cylinder comprising polycarbonate resin, which is the raw material of the photoreceptor, was used as the cylindrical unit 56, a belt comprising a mixture of polycarbonate resin and polybutyrate resin and having on the surface thereof a toner resin layer comprising a styrene-acrylic resin mixture was used as the belt 57, and a solid lubricant was applied to the surfaces of the cylindrical unit 56 and the belt 57. Measurement was then taken with the application of weight W of the plumb bob 58=100 g.

When the frictional coefficient μ2 between toner TN particles was measured, a toner resin layer was formed on the surface of the cylindrical unit 56, a belt having a toner resin layer on the surface thereof was used as the belt 57, and a solid lubricant was applied to the surfaces of both toner resin layers. Measurement was then performed with the application of weight W of the plumb bob 58=100 g.

During measurement of the frictional coefficient μ1 and of the frictional coefficient μ2 between toner TN particles, when the same lubricant was used, the same reading was obtained for both coefficients. In other words, the frictional coefficient μ did not depend on the type of resin on which the solid lubricant was applied, but on the type of solid lubricant used.

[Type of Solid Lubricant and Combination]

The types of solid lubricant M1 that may be used as the first lubricant applied to the photoreceptor surface and the types of solid lubricant M2 that may be used as the second lubricant that are added to the toner, as well as combinations thereof, will now be explained. Both the solid lubricant M1 applied to the photoreceptor surface and the solid lubricant M2 added to the toner must have low surface energy and be chemically inactive and thermally stable.

Specifically, higher fatty acid metallic salts (metallic soaps) such as zinc stearate (ST-Zn), magnesium stearate (ST-Mg) and calcium stearate (ST-Ca) or fluorinated polymers such as PTFE, ETFE and polyvinyliden fluoride are the appropriate substances.

Figure 6:
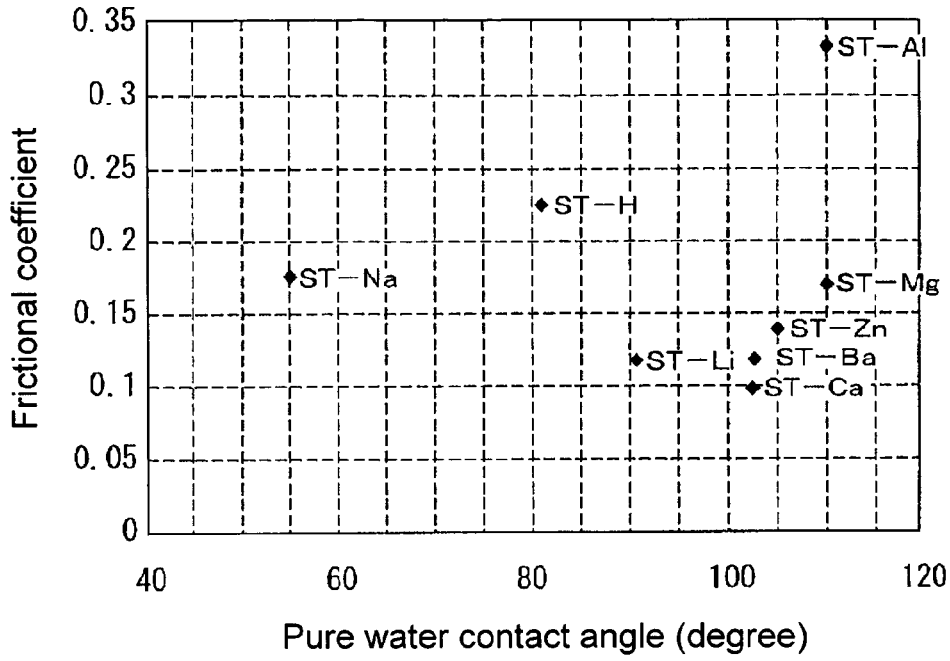
FIG. 6 is an explanatory drawing showing the relationship between the pure water contact angle and the frictional coefficient regarding various solid lubricants.

FIG. 6 is an explanatory drawing to show the relationship between the pure water contact angle and the frictional coefficient with regard to stearic acid (ST-H) comprising a solid lubricant, and sodium stearate (ST-Na), lithiumstearate (ST-Li), aluminumstearate (ST-Al), magnesium stearate (ST-Mg), zinc stearate (ST-Zn), barium stearate (ST-Ba) and calcium stearate (ST-Ca), which are stearic metallic salts.

As is clear from FIG. 6, the solid lubricant frictional coefficient μ varies depending on the type of solid lubricant used. Therefore, in order to maintain the desired relationship between the frictional coefficients μ of the solid lubricant M1 applied to the photoreceptor and the solid lubricant M2 added to the toner, an appropriate combination of solid lubricants must be selected based on the characteristic values shown in FIG. 6.

As explained above, it is desirable for the pure water contact angle θ1 of the solid lubricant M1 applied to the photoreceptor and the pure water contact angle θ2 of the solid lubricant M2 added to the toner to have the relationship $\theta 1 \leqq \theta 2$, and that the frictional coefficient μ1 of the solid lubricant M1 and the frictional coefficient μ2 of the solid lubricant M2 have the relationship $\mu 1 < \mu 2$.

Therefore, with reference to FIG. 6, where zinc stearate (ST-Zn) is selected as the solid lubricant M1 applied to the photoreceptor surface, it is desired that magnesium stearate (ST-Mg) or aluminum stearate (ST-Al) that have a larger pure water contact angle θ and frictional coefficient μ than zinc stearate (ST-Zn) be selected.

In addition, it is preferred that the amount of solid lubricant M2 added to the developer range between 0.01% and 5.0% by weight, and that the solid lubricant M1 be solidified to enable it to be taken up by the application brush and applied to the photoreceptor.

Figure 7:
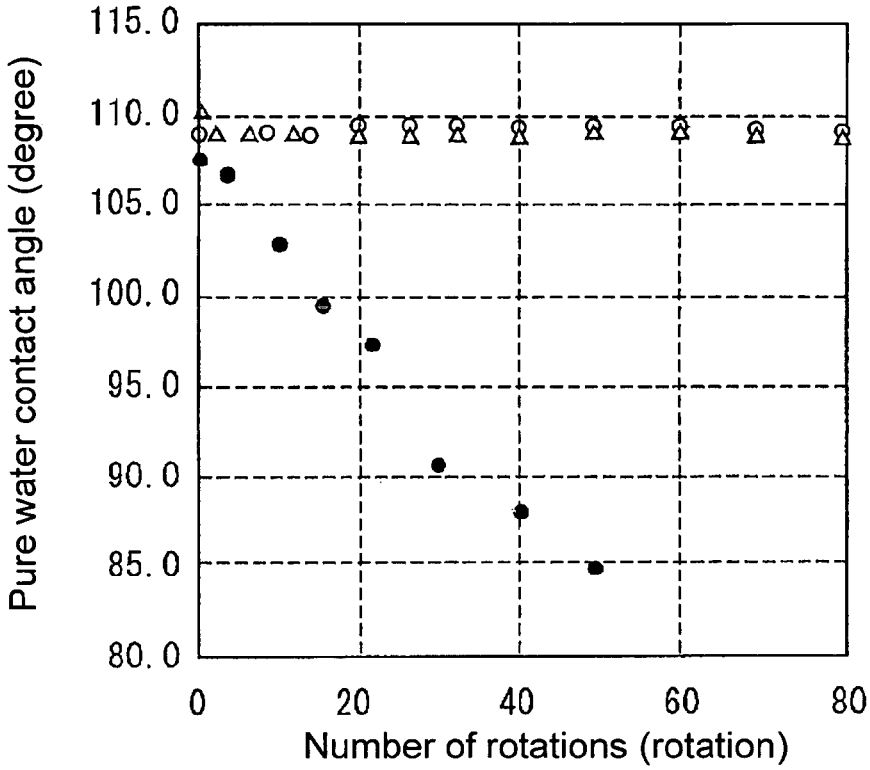
FIG. 7 is an explanatory drawing showing the relationship between the pure water contact angle and the photoreceptor rotation rate when a solid lubricant is added to the toner and when no solid lubricant is added to the toner.

FIG. 7 is a drawing showing the results obtained when the relationship between the pure water contact angle θ and the number of rotations (unit of measurement: rotation) of the photoreceptor was measured with the addition of a solid lubricant to the toner and without the addition of a solid lubricant to the toner. It indicates the effect obtained when a solid lubricant is added to the toner.

In this measurement, zinc stearate (ST-Zn) was selected as the solid lubricant M1 applied to the photoreceptor surface. For the solid lubricant M2 added to the developer, Sample 1 comprising toner having a 4.5 μm particle diameter to which 0.3% by weight of aluminum stearate (ST-Al) was added, Sample 2 comprising toner having a 4.5 μm particle diameter to which 0.5% by weight of magnesium stearate (ST-Mg) was added, and Sample 3 comprising toner having a 4.5 μm particle diameter to which no solid lubricant was added were prepared.

A test latent image formed on the photoreceptor surface was developed using Samples 1-3, respectively, and the pure water contact angle of the photoreceptor surface was measured. This measurement was repeated while the number of rotations of the photoreceptor was changed.

As is clear from FIG. 7, little reduction in the photoreceptor surface contact angle, i.e., in the solid lubricant comprising zinc stearate (ST-Zn) applied to the surface, was observed with Sample 1 (comprising toner having a 4.5 μm particle diameter to which 0.3% by weight of aluminum stearate (ST-Al) was added) and Sample 2 (comprising toner having a 4.5 μm particle diameter to which 0.5% by weight of magnesium stearate (ST-Mg) was added), when the number of rotations of the photoreceptor was increased. On the other hand, with Sample 3 (comprising toner having a 4.5 μm particle diameter to which no solid lubricant was added), a marked reduction in zinc stearate (ST-Zn), i.e., the solid lubricant applied to the surface, was observed as the number of rotations of the photoreceptor increased. As a result, the effectiveness of the solid lubricant M2 added to the toner was thereby proven.

Zinc stearate (ST-Zn) and calcium stearate (ST-Ca) were then applied respectively to the photoreceptor surface as the solid lubricant M1 and the rate of reduction in the pure water contact angle of the photoreceptor surface was measured when various metallic soaps (stearic salts) or stearic acid were used as the solid lubricant M2 added to the toner. The results of these tests are shown in FIG. 8.

The rate of contact angle reduction here is the amount of reduction of the photoreceptor surface contact angle relative to the initial contact angle when development was carried out using a photoreceptor to which a solid lubricant M1 was applied. The measurement was taken when the photoreceptor had rotated ten times.

Where zinc stearate (ST-Zn) or calcium stearate (ST-Ca) was used as the solid lubricant M1, it was observed that there was little reduction in the photoreceptor surface contact angle and very little of the solid lubricant M1 applied to the photoreceptor surface was peeled off if the solid lubricant M1 contact angle $\theta 1$ and the solid lubricant M2 contact angle $\theta 2$ had the relationship $\theta 1 \leqq \theta 2$.

The minimum contact pressure was then measured when zinc stearate (ST-Zn) was applied to the photoreceptor surface as the solid lubricant M1, and various metallic soaps (stearic salts) were respectively used as the solid lubricant M2 added to the toner. The results of these tests are shown in FIG. 9.

In these tests, 'the minimum contact pressure' was the smallest pressure that the cleaning blade needed to exert in order to clean off the toner. Specifically, the image forming apparatus shown in FIG. 1 was modified such that the contact pressure exerted by the cleaning blade to the photoreceptor could be varied. The transfer mechanism was also removed from the apparatus. Using this image forming apparatus, a toner image (a solid image that has 3 $g/m^3$ of adhering toner and is longer than the circumference of the photoreceptor) was formed on the photoreceptor, and the toner remaining on the photoreceptor after cleaning was visually evaluated. This evaluation was repeated each time the contact pressure was changed, and the smallest contact pressure at which no residual toner or a very little amount of residual toner was observed was deemed the minimum contact pressure. A lower minimum contact pressure indicates a better cleaning capability.

It was shown that where the solid lubricant M2 comprised sodium stearate (ST-Na), stearic acid (ST-H) or aluminum stearate (ST-Al), which have a larger frictional coefficient than zinc stearate (ST-Zn), i.e., where the frictional coefficients had the relationship $\mu 1 < \mu 2$, a lower minimum contact pressure was obtained than when no solid lubricant M2 was added to the toner, indicating a better cleaning capability.

The present invention was described using as an example a commonly used image forming apparatus in which the present invention was applied, but needless to say, the present invention can be applied in a monochrome image forming apparatus, a color image forming apparatus, a printer, a facsimile machine or a multifunction peripheral combining the functions of these apparatuses.

The embodiments disclosed herein are examples in every aspect and do not limit the present invention in any respect. The range of the present invention is indicated not by the description provided above but by the claims, and is intended to include constructions equivalent to the claims, as well as all changes and modifications within the scope thereof.

What is claimed as:

1. An image forming apparatus comprising:

an image carrier;

a lubricant application device that applies a first lubricant to the image carrier surface; and a developing device that houses a developer to which a second lubricant is added and develops the electrostatic latent image formed on the image carrier:

wherein the pure water contact angle $\theta 1$ of the first lubricant and the pure water contact angle $\theta 2$ of the second lubricant have the following relationship:

$$\theta 1 < \theta 2.$$

2. The image forming apparatus according to claim 1:

wherein the frictional coefficient $\mu 1$ of the first lubricant and the frictional coefficient $\mu 2$ of the second lubricant have the following relationship:

$$\mu 1 < \mu 2.$$

3. The image forming apparatus according to claim 1:

wherein the lubricant application device comprises a rotatable member coming into contact with the image carrier surface and the solid first lubricant that is forced in the direction of contact with the rotatable member; and the rotatable member rotates to take up some of the solid first lubricant, and applies the first lubricant onto the image carrier surface.

4. The image forming apparatus according to claim 3, wherein the rotatable member is a rotatable brush that is disposed parallel to the image carrier and is driven to rotate by the image carrier.

5. The image forming apparatus according to claim 1, wherein each of the first lubricant and the second lubricant comprises a fatty acid metallic salt.

6. The image forming apparatus according to claim 1, wherein each of the first lubricant and the second lubricant comprise stearic acid or a stearic metallic salt.

7. An image forming apparatus comprising:

an image carrier;

a lubricant application device that applies a first lubricant to the image carrier surface; and developing device that houses a developer to which a second lubricant is added and that develops the electrostatic latent image formed on the image carrier:

wherein the frictional coefficient $\mu 1$ of the first lubricant and the frictional coefficient $\mu 2$ of the second lubricant have the following relationship:

$$\mu 1 < \mu 2.$$

8. The image forming apparatus according to claim 7:

wherein the lubricant application device comprises a rotatable member coming into contact with the image carrier surface, and the solid first lubricant that is forced in the direction of contact with the rotatable member; and the rotatable member rotates to take up some of the solid first lubricant, and applies the first lubricant onto the image carrier surface.

9. The image forming apparatus according to claim 8, wherein the rotatable member is a rotatable brush that is disposed parallel to the image carrier and is driven to rotate by the image carrier.

10. The image forming apparatus according to claim 7, wherein each of the first lubricant and the second lubricant comprises a fatty acid metallic salt.

11. The image forming apparatus according to claim 7, wherein each of the first lubricant and the second lubricant comprises a stearic acid or a stearic metallic salt.

12. The image forming method comprising the steps of:
applying a first lubricant to an image carrier surface;
charging the image carrier surface;
forming an electrostatic latent image via light irradiation of the charged image carrier surface; and
developing to electrostatic latent hinge using a developing device that house a developer to which a second lubricant is added;
wherein the pure water contact angle θ1 of the first lubricant and the pure water contact angle θ2 of the second lubricant have the following relationship:

$$\theta 1<\theta 2.$$

13. The hinge forming method according to claim 12, wherein the frictional coefficient μ1 of the first lubricant and the frictional coefficient μ2 of the second lubricant have the following relationship:

$$\mu 1<\mu 2.$$

14. The image forming method according to claim 12, wherein the step of applying comprises:
taking up some of a solid first lubricant by a rotatable member coming into contact with the image carrier surface; and
applying the first lubricant onto the image carrier surface by the rotatable member.

15. The image forming method according to claim 14, wherein the rotatable member is a rotatable brush that is disposed parallel to the image carrier and is driven to rotate by the image carrier.

16. The image forming method according to aim 12, wherein each of the first lubricant and the second lubricant comprises a fatty acid metallic salt.

17. The image forming method according to claim 12, wherein each of the first lubricant and the second lubricant comprises a stearic acid or a stearic metallic salt.

18. The image forming method comprising the steps of:
applying a first lubricant to an image carrier surface;
charging the image carrier surface;
forming an electrostatic latent image via light irradiation of the charged image carrier surface; and
developing the electrostatic latent image using a developing device that houses a developer to which a second lubricant is added:
wherein the frictional coefficient μ1 of the first lubricant and the frictional coefficient μ2 of the second lubricant have the following relationship:

$$\mu 1<\mu 2.$$

19. The image forming method according to claim 18, wherein the step of applying comprises:
taking up some of a solid first lubricant by a rotatable member coming into contact with the image carrier surface; and
applying the first lubricant onto the image carrier surface by the rotatable member.

20. The image forming method according to claim 19, wherein the rotatable member is a rotatable brush that is disposed parallel to the image carrier and is driven to rotate by the image carrier.

21. An image forming apparatus comprising:
an image carrier;
a lubricant application device that applies a first lubricant to the image carrier surface; and
a developing device, different from said lubricant application device, that houses a developer to which a second lubricant is added and develops the electrostatic latent image formed on the image carrier:
wherein the pure water contact angle θ1 of the first lubricant and the pure water contact angle θ2 of the second lubricant have the following relationship:

$$\theta 1<\theta 2.$$

22. The image forming device of claim 21, wherein said first lubricant is the same lubricant as said second lubricant.

23. The image forming device of claim 21, wherein said first lubricant is different from said second lubricant.

24. An image forming method comprising the steps of:
applying a first lubricant to an image carrier surface by means of a lubricant application device;
charging the image carrier surface;
forming an electrostatic latent image via light irradiation of the charged image carrier surface; and
developing the electrostatic latent image using developing device that is different from said lubricant application device and that houses a developer to which a second lubricant is added;
wherein the pure water contact angle θ1 of the first lubricant and the pure water contact angle θ2 of the second lubricant have the following relationship:

$$\theta 1<\theta 2.$$

25. The image forming method of claim 24, wherein said first lubricant is the same lubricant as said second lubricant.

26. The image forming method of claim 24, wherein said first lubricant is different from said second lubricant.

* * * * *